US006209596B1

(12) United States Patent
Wong

(10) Patent No.: US 6,209,596 B1
(45) Date of Patent: Apr. 3, 2001

(54) METHOD AND DEVICE FOR MOUNTING A FLEXIBLE BAG

(76) Inventor: Stephen King-Tong Wong, 5 Echo Valley Ridge, Toronto, Ontario (CA), M9B 2B2

( * ) Notice: Subject to any disclaimer, the term of this patent is extended or adjusted under 35 U.S.C. 154(b) by 0 days.

(21) Appl. No.: 09/532,313

(22) Filed: Mar. 22, 2000

(51) Int. Cl.[7] ..... B65B 1/04

(52) U.S. Cl. ..... 141/391; 141/314; 248/101

(58) Field of Search ..... 141/391, 114, 141/313–316, 10, 166; 248/99, 101, 152

(56) References Cited

U.S. PATENT DOCUMENTS 2,827,931 * 3/1958 Melvin .
3,818,956 * 6/1974 Chamberlain ..... 141/316
5,655,739 * 8/1997 Goo ..... 248/101

* cited by examiner

*Primary Examiner*—Steven O. Douglas

(57) ABSTRACT

This device is for maintaining a flexible bag in an open manner. It has an inner hoop having an outer side wall sloping inwardly and downwardly, and an outer binder which is provided with a through opening having a complementary shape and size adapted to embrace the outer side wall of the inner hoop. The flexible bag is mounted between the inner hoop and the outer binder by first inserting the bag through the inner hoop with the bag's lip portion folded backwards to cover over the outer side wall of the inner loop. The outer binder is then fitted over the inner hoop with the folded back lip portion of the bag sandwiched between the engaging inner hoop and the outer binder. When the bag is being filled, the weight in the bag will inherently pull the inner hoop and the outer binder to engage with each other with increasing force as the weight of the load increases, and thus, in turn, securing the bag even more tightly to the device.

17 Claims, 10 Drawing Sheets

METHOD AND DEVICE FOR MOUNTING A FLEXIBLE BAG

BACKGROUND OF THE INVENTION

This invention relates to a method and device to hold a flexible bag in an open manner in order to facilitate its filling.

Bags such as refuse bags, shopping bags etc., used for collecting and holding objects are commonly made of flexible material such as plastics, fabric, paper or other synthetics. They are normally used for holding objects either for easy transportation, storage, or disposal. The most annoying problem in using a bag made of a flexible material is to maintain it in an open manner for filling. However, it is sometimes awkward for a user to open the bag with one hand while filling it with the other. For example, when using a flexible refuse bag outdoor for collecting leaves in the fall, the flexible bag would be fluttered by the wind which makes maintaining the bag in the open condition extremely difficult. Even indoor, it is inefficient and troublesome to maintain the bag opened with one hand and to fill it with the other only free hand.

Many devices have been developed to alleviate the above problem. One common device is in the form of a fixed bracket designed to match the size of the bag or slightly larger. The flexible bag may be mounted by stretching its lip portion to wrap tightly over the bracket. The resilient tension of the bag material would maintain the bag in the open manner. With this device, the bracket must have a relatively larger dimension than the lip portion of the bag creating the resilient tension strong enough to hold the bag mounted in an open manner. Often times, the lip portion of the bag would be torn when the user attempts to stretch it to wrap over the bracket. Furthermore, in use, the weight of the load in the bag would simply pull the bag off from the bracket. The latter problem may be mitigated by providing a support container having a comparable size as the bag. It may be placed within the container with its lip portion again stretched and wrapped tightly around the upper opened rim portion of the container so that the container would support the weight of the load within the bag. However, the bulkiness of the container makes it difficult to be carried around. The container would occupy storage space, and the lip portion of the bag is still subject to the tearing problem. It is also difficult to remove the bag from the container for its final destination, and therefore, it limits the benefits of using flexible bags.

There are devices for maintaining a flexible bag in the open condition with a bracket having fasteners provided thereon. The lip portion of the bag can be secured to the bracket by the fasteners. In U.S. Pat. No. 5,718,469 to F. G. Ockerman, it shows a portable mounting device for a flexible bag used for collecting and disposing animal excrement. The device consists of a larger annular ring and a smaller annular ring. The smaller ring is insertable into the larger ring so that the lip portion of the flexible bag may be sandwiched between the two rings thus mounted together. Adjustable and engageable fasteners are provided between the two annular rings for maintaining the two rings tightly mounted together. Such device is not desirable for mounting a flexible bag intended for holding objects having a relatively heavy weight since the weight of the objects would pull the bag out of the mounting.

U.S. Pat. No. 1,414,575 to T. McCart shows a bag holder which consists of an annular base mounted on three supporting legs. The inner side wall of the annular base has a stepped configuration which is engageable with the similarly step configured outer side wall of a funnel shaped chute. The lip portion of a flexible bag can be sandwiched and grasped between the base of the chute so as to maintain it in the open condition. Such device would inherently damage the lip portion of the bag by the grasping action between the base and the chute. The weight of the load in the bag would also tend to pull the bag out from the mounting.

SUMMARY OF THE INVENTION

It is a principal object of the present invention to provide a mounting device and method to hold a flexible bag in an open condition for filling operation.

It is another object of the present invention to provide a mounting device in which the increasing weight of the load in the bag would enhance the tighter mounting force of the bag to the device.

It is another object of the present invention to provide a mounting device which is simple in construction and yet is easy to operate.

It is still another object of the present invention to provide a mounting device which would not cause any damage to the bag in its operation.

DESCRIPTION OF THE DRAWINGS

Other objects and advantages of the present invention will become apparent from the following detailed description of the preferred embodiments thereof in connection with the accompanying drawings in which.

DETAILED DESCRIPTION OF THE PREFERRED EMBODIMENTS

Figure 1:
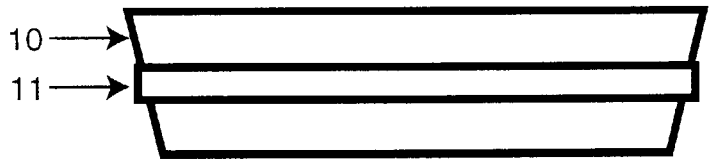
FIG. 1 is a schematic side elevation view of two engaging hoops with the inner hoop having sloping side walls, illustrating the basic concept of the present invention.
Figure 2:
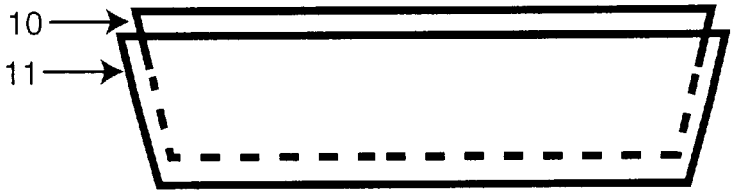
FIG. 2 is a schematic side elevation view of two engaging hoops with both hoops having mating sloping side walls, illustrating the basic concept of the present invention.
Figure 3:
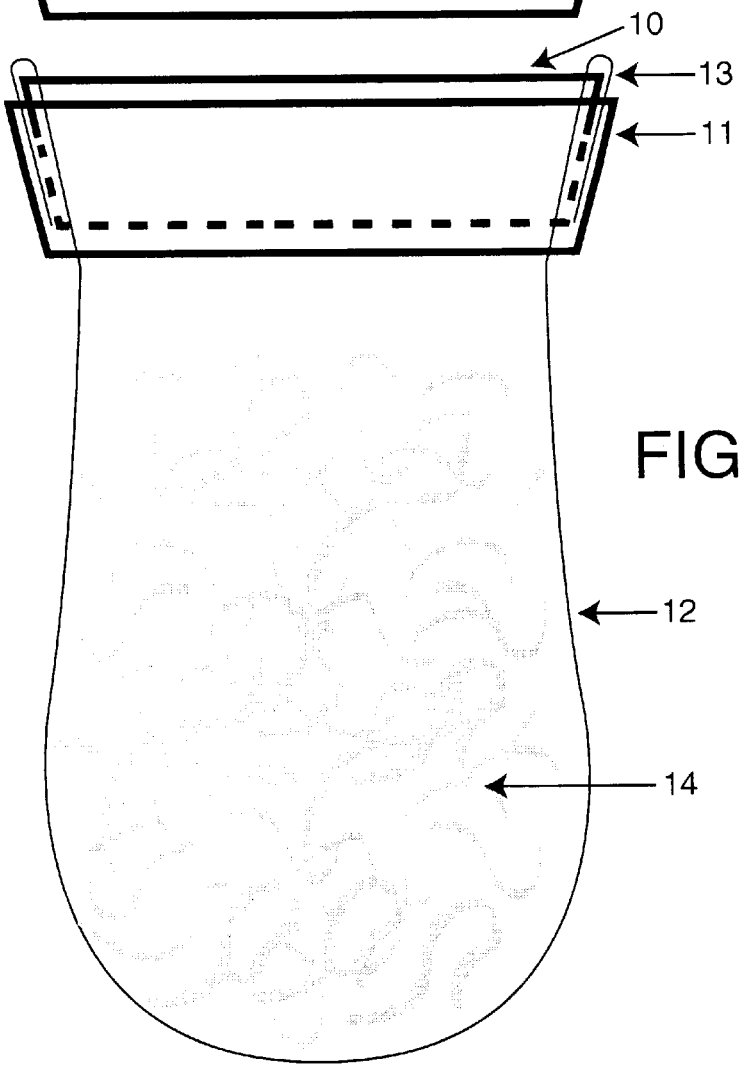
FIG. 3 is a schematic sectional side elevation view of the two engaging hoops of FIG. 2 with a flexible bag mounted thereto.

With reference to the drawings wherein like reference numerals designate corresponding parts in the several views, the basic principle of the present invention is generally shown in FIGS. 1 through 6. The basic components of the present device comprises of an inner hoop 10 having an outer side wall sloping downwardly and inwardly and an outer binder 11 in the form of a hoop having an inner side wall with a shape and size adapted to fit over the outer side wall of the inner hoop 10. As shown in FIG. 1, the inner side wall of the outer binder 11 is substantially flat and vertical. The inner side wall of the outer binder 11 may also have a similar sloping shape as the outer side wall of the inner hoop 10 as best shown in FIG. 2 such that the inner hoop 10 and the outer binder 11 may mate intimately with each other. A flexible bag 12 may be mounted to the device as best shown in FIG. 3 with the flexible bag 12 first inserted through the inner hoop 10 and then with the bag's lip portion 13 folded over to wrap over the outer side wall of the inner hoops 10. The outer binder 11 is then fitted over the inner hoop 10 to sandwich the bag's lip portion 13 between the inner hoop 10 and the outer binder 11. The device would maintain the flexible bag 12 in the open manner for filling a load 14 into the bag. The weight of the load 14 will exert a pulling force downwards on the inner hoop 10 to cause it to engage tightly with the outer binder 11. As the bag is being filled, the increasing weight of the load will correspondingly exert an increasing force to grasp the bag's lip portion more tightly between the mating inner hoop 10 and the outer binder 11.

Figure 4:
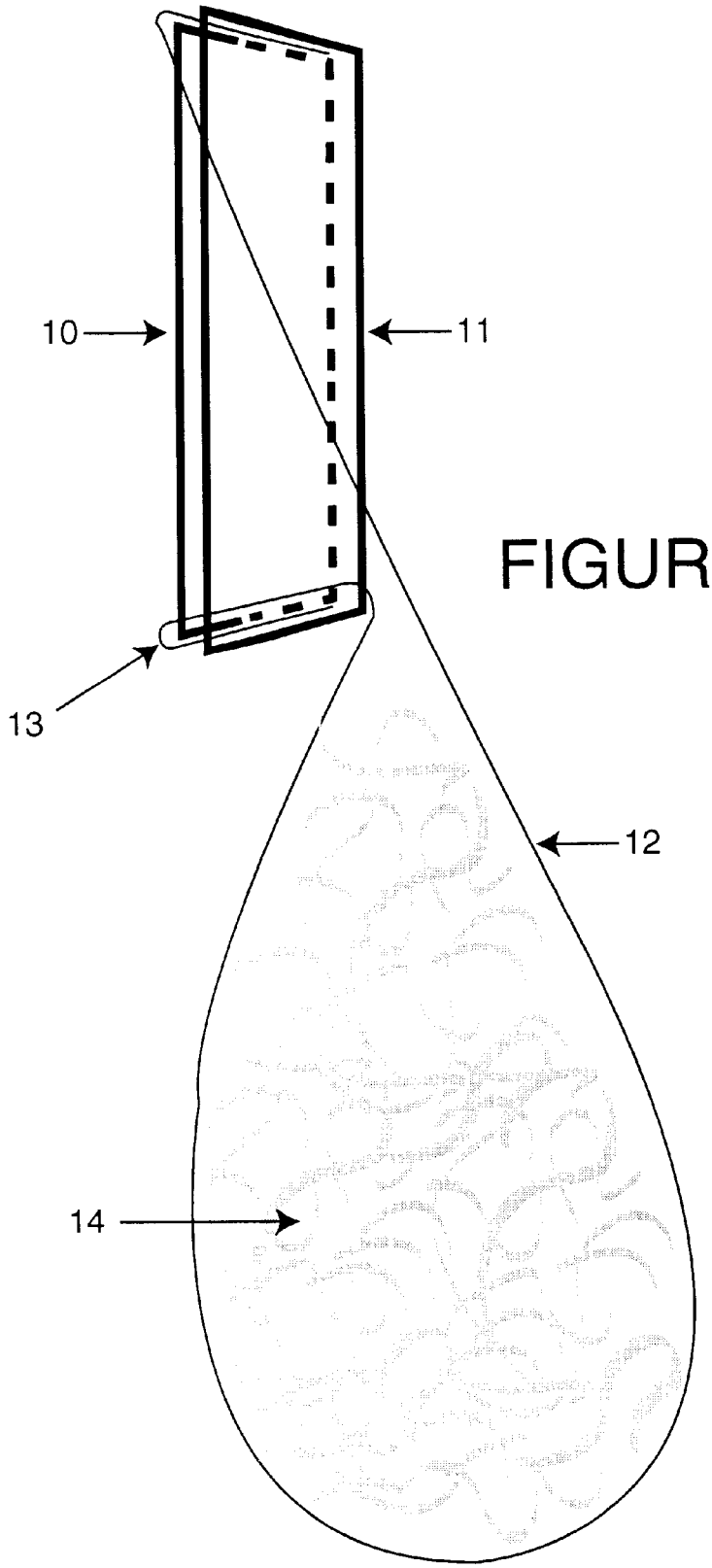
FIG. 4 is a schematic side elevation view of the device of FIG. 3 turned to a 90 degree position.
Figure 6:
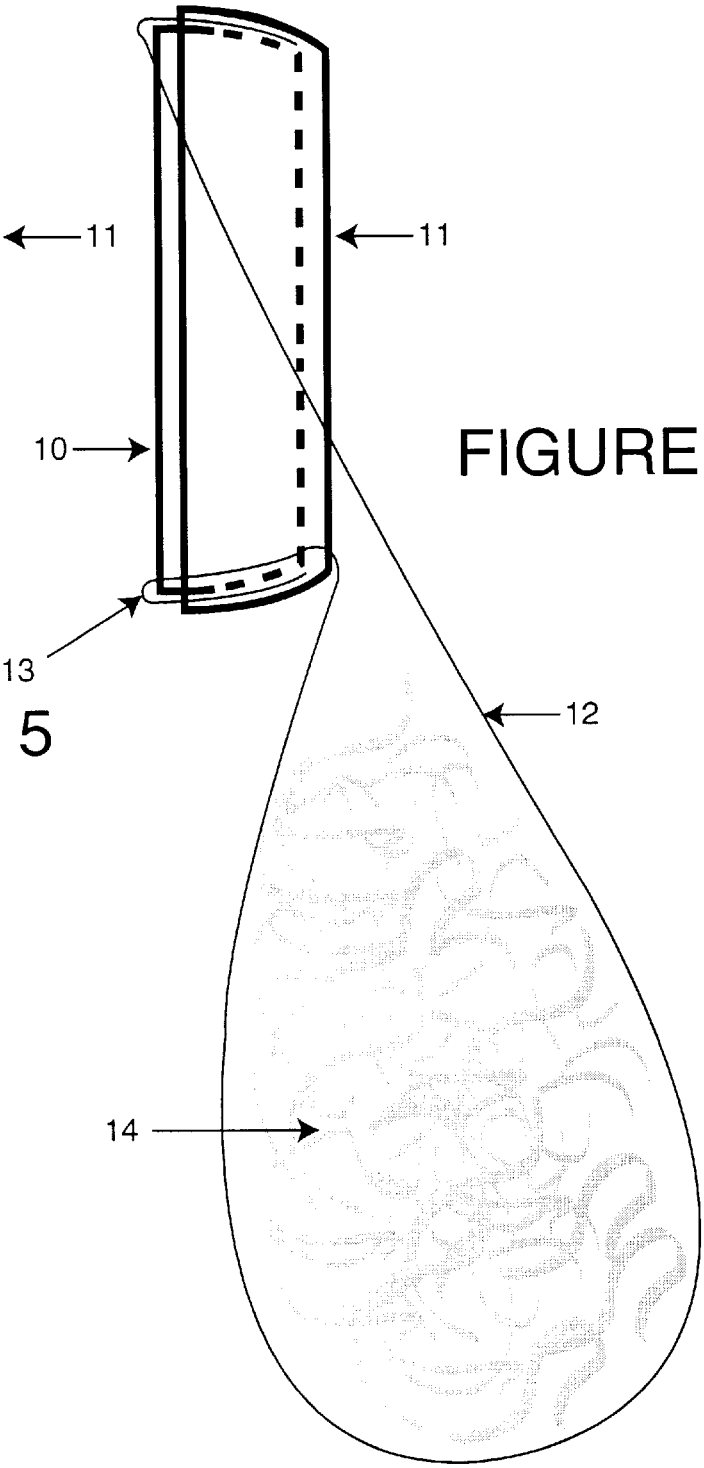
FIG. 6 is a schematic side elevation view of the device of FIG. 5 with a flexible bag mounted thereto and with a load located inside the bag.

When the device is tilted to a substantially 90 degrees position as shown in FIG. 4 and FIG. 6, the weight of the load 14 in the bag 12 will pull and cause the inner hoop 10 to engage more tightly with the outer binder 11 as well as closing the opening of the bag as long as the vector of the downward force of the load falls within the combined center of gravity of the mating inner hoop and outer binder. Thus, the device with the bag mounted thereon is convenient for carrying around in a portable manner.

Figure 5:
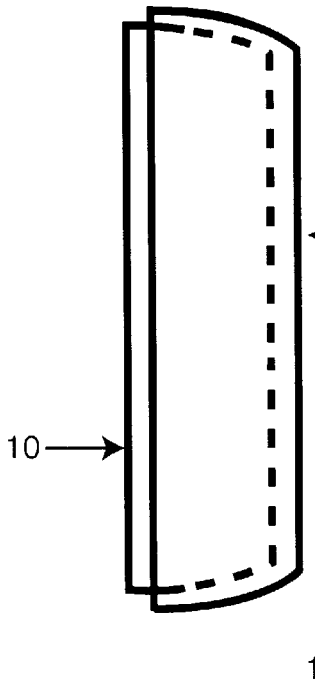
FIG. 5 is a schematic side elevation view of two engaging hoops both having curved sloping side walls engaging with each other according to the present invention.

The inner hoop 10 and the outer binder 11 may have mating curved side walls as shown in FIGS. 5 and 6.

The flexible bag 12 with or without a load therein may be removed from the device by simply separating the inner hoop 10 and outer binder 11 apart from each other and, unfolding the lip portion 13 from the inner hoop 10 to remove the bag 12 therefrom.

Figure 7:
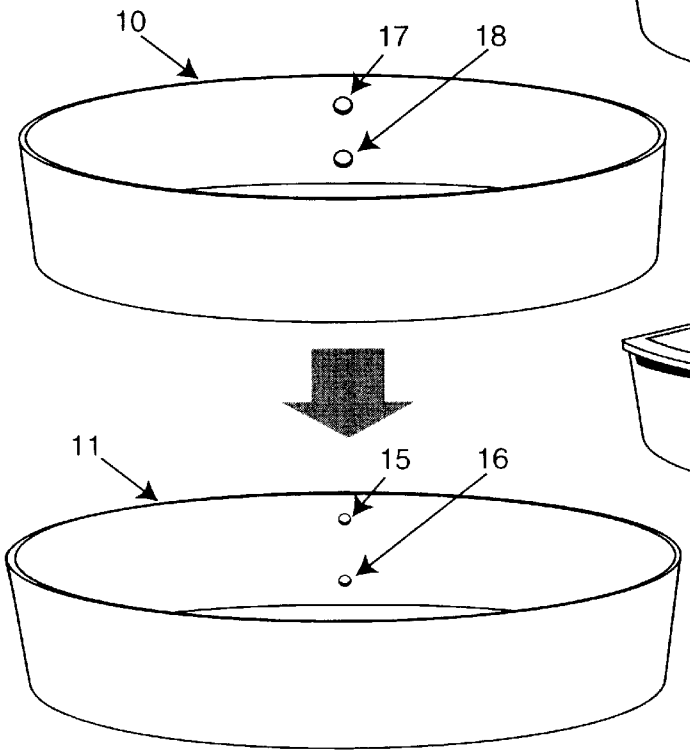
FIG. 7 is a perspective exploded side elevation view showing the basic device of the present invention in the form of two circular hoops having mating side walls.

It can be appreciated by those skilled in the art that the inner hoop 10 and the outer binder 11 may have various different shapes as long as the outer side walls of the inner hoop 10 and the inner side walls of the outer binder 11 have a matching shape and size. For illustration purposes, as shown in FIG. 7, the outer side wall of the inner hoop 10 and the inner side wall of the outer binder 11 have a circular shape and similar complementary matching size so that they may engage with each other. Such circular shape device may also be mounted to a vertical supporting wall surface with mounting openings 15 and 16 provided in the side wall of the outer binder 11. The associated large openings 17 and 18 can be formed respectively in the side wall of the inner hoop 10. The openings 17 and 18 will be in registry with the openings 15 and 16 when the inner hoop 10 and the outer binder 11 are fitted together so as to accommodate the head of the screws or nails used for mounting the device to the vertical supporting wall surface.

Figure 8:
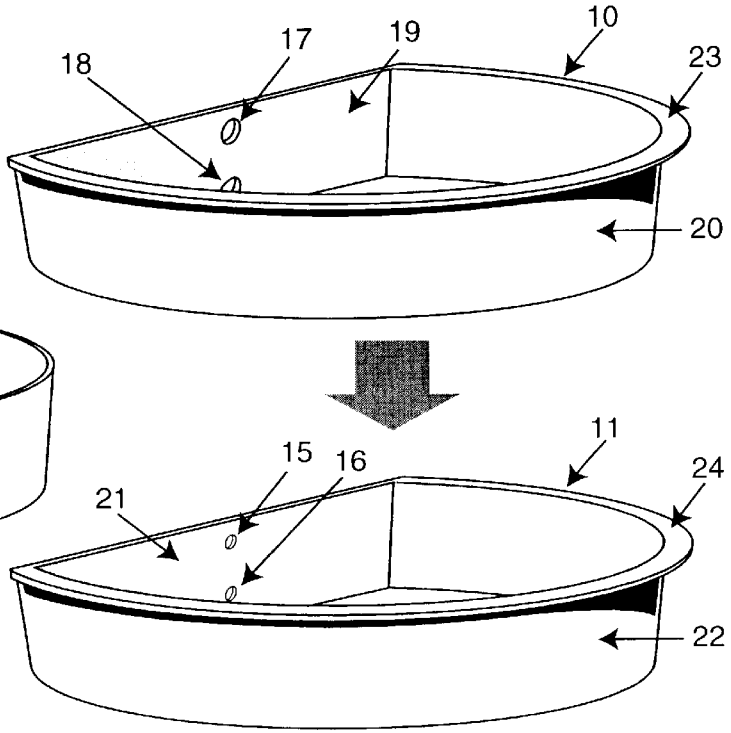
FIG. 8 is a perspective exploded side elevation view showing two hoops, each hoop having a flat back side wall and an arcuate front side wall and an additional horizontal flange.

As shown in FIG. 8, the inner hoop 10 may have a flat rear side wall 19 and a curved front side wall 20, while the outer binder 11 may have a similar hoop shape having a corresponding flat rear side wall 21 and a curved front side wall 22. The outer side wall of the inner hoop 10 and the inner side wall of the outer binder 11 have matching slope and size so that they may mate with each other intimately. Mounting openings 15 and 16 are provided in the flat rear side wall 21 of the outer binder 11 and associated openings 17 and 18 are formed in the flat rear side wall 19 of the inner hoop 10. A flange 23 is formed at the top edge of the curved front side wall 20 of the inner hoop 10 and a corresponding flange 24 is also formed at the top edge of the curved front side wall of the outer binder 11.

Figure 9:
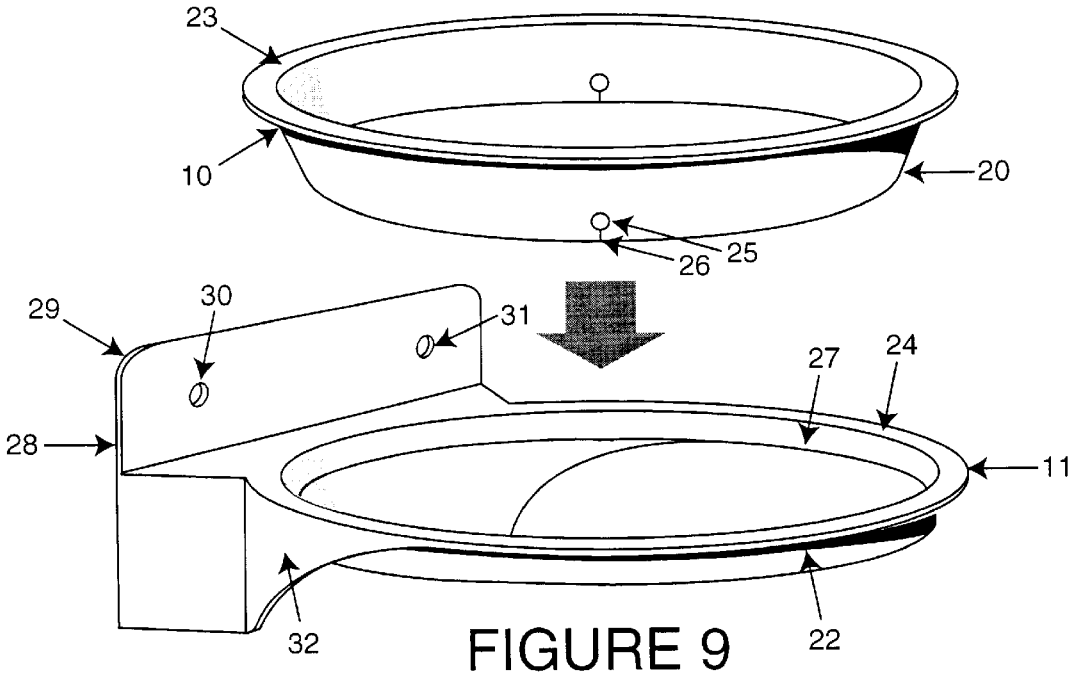
FIG. 9 is a perspective exploded front elevation view showing a preferred embodiment of the device of the present invention.
Figure 10:
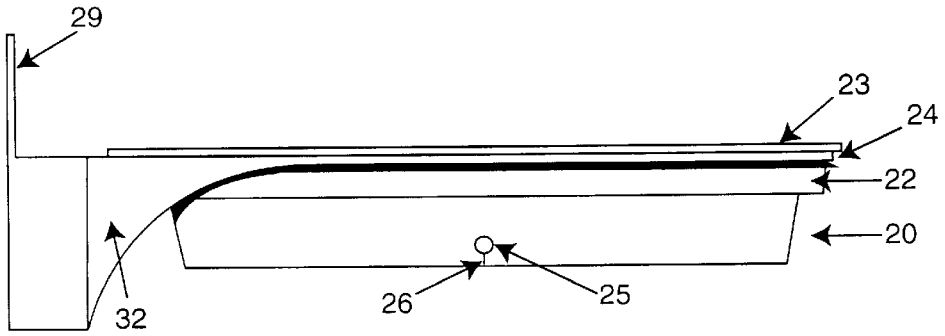
FIG. 10 is a perspective side elevation view of the FIG. 9 with the inner hoop inserted into the outer binder hoop.
Figure 11:
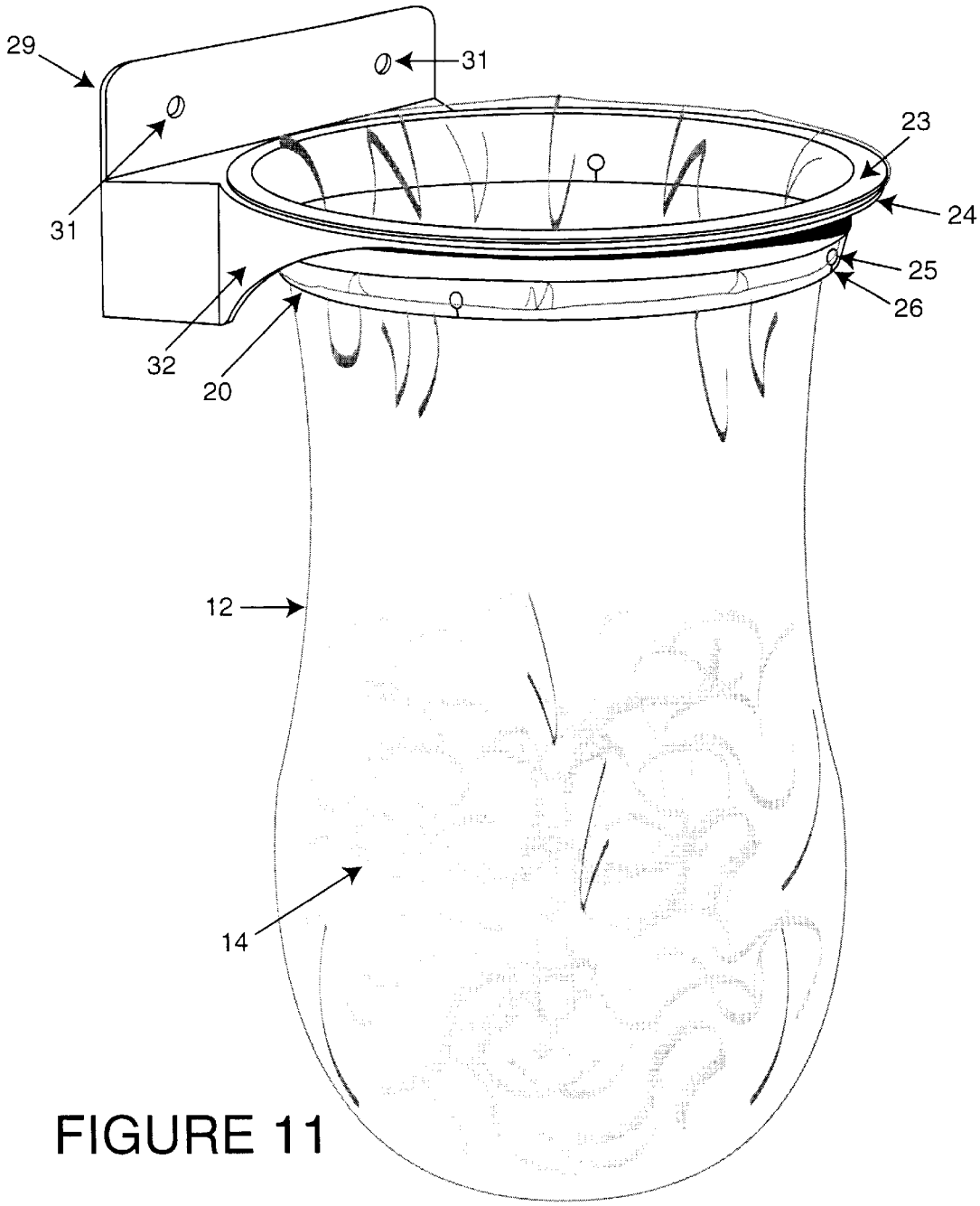
FIG. 11 is a perspective front elevation view of the device shown in FIG. 9 with a flexible bag mounted thereto.

A preferred embodiment of the device of the present invention particularly suitable for mounting it to a vertical supporting wall surface is best shown in FIGS. 9, 10 and 11. In this embodiment, the inner hoop 10 is in the form of a circular hoop having a flange 23 provided at its entire top edge. The size of the inner hoop 10 may be equal to or smaller than a conventional load collection flexible bag. Four retainer openings 25 are formed close to the lower edge 26 of the inner hoop 10. The retainer opening 25 are spaced evenly over the side wall 20 of the inner hoop 10. A slit opening 26 extends from each retainer opening 25 to the lower edge 26. The outer binder 11 is in the form of a narrow hoop having a flange 24 formed at its top edge and a narrow side wall 22. The top flange 23 of the inner hoop 10 may be wider than the top flange 24 of the outer binder 11 such that when the inner hoop 10 is fitted within the outer binder 11, the top flange 23 extends outwards beyond the peripheral edge of the top flange 24 of the outer binder 11. The outer side wall 20 of the inner hoop 10 is sloping downwardly and inwardly and the inner side wall 27 of the outer binder has a matching size to the outer side wall of the inner hoop 10. The inner side wall 27 of the outer binder 11 may either have a matching complementary slope as the outer side wall 20 of the inner hoop 10 or just simply be vertical. The inner diameter of the outer binder 11 may be equal to or slightly larger than the outer diameter of the inner hoop 10, such that the inner hoop 10 fits easily into the outer binder 11. An extension portion 28 is formed at the rear portion of the outer binder 11. The extension portion 28 has a vertical rear portion 29 and mounting openings 30 and 31 are formed therein so that the device may be mounted to a vertical supporting wall in a cantilever manner. A reinforcing neck portion 32 is provided between the extension portion 28 and the outer binder 11 so as to support the weight exerted on the outer binder 11 by the load in the flexible bag mounted to device.

In FIG. 11 the flexible bag 12 may be mounted to the device as best shown. The flexible bag 12 is first inserted through the inner hoop 10 with its lip portion wrapping over the upper flange 23 and the outer side wall 20 of the inner hoop 10. Sideway folded portions may be formed in the flexible bag's lip portion if the bag is larger than the diameter of the inner hoop 10. These sideway folded portions may be slipped or poked through the slits 26 into the retaining openings 25 for temporarily holding the flexible bag mounted to the inner hoop 10. The inner hoop 10 with the flexible bag 12 thus mounted may then be placed into the outer binder 11 until the folded over lip portion of the bag is sandwiched tightly between the mating inner hoop 10's flange 23 and outer binder 11's flange 24. The bag 12 may easily be removed by simply pushing the inner hoop 10 upwards by its lower edge or by pulling its flange 23 upwards to disengage it from the outer binder 11.

Figure 12:
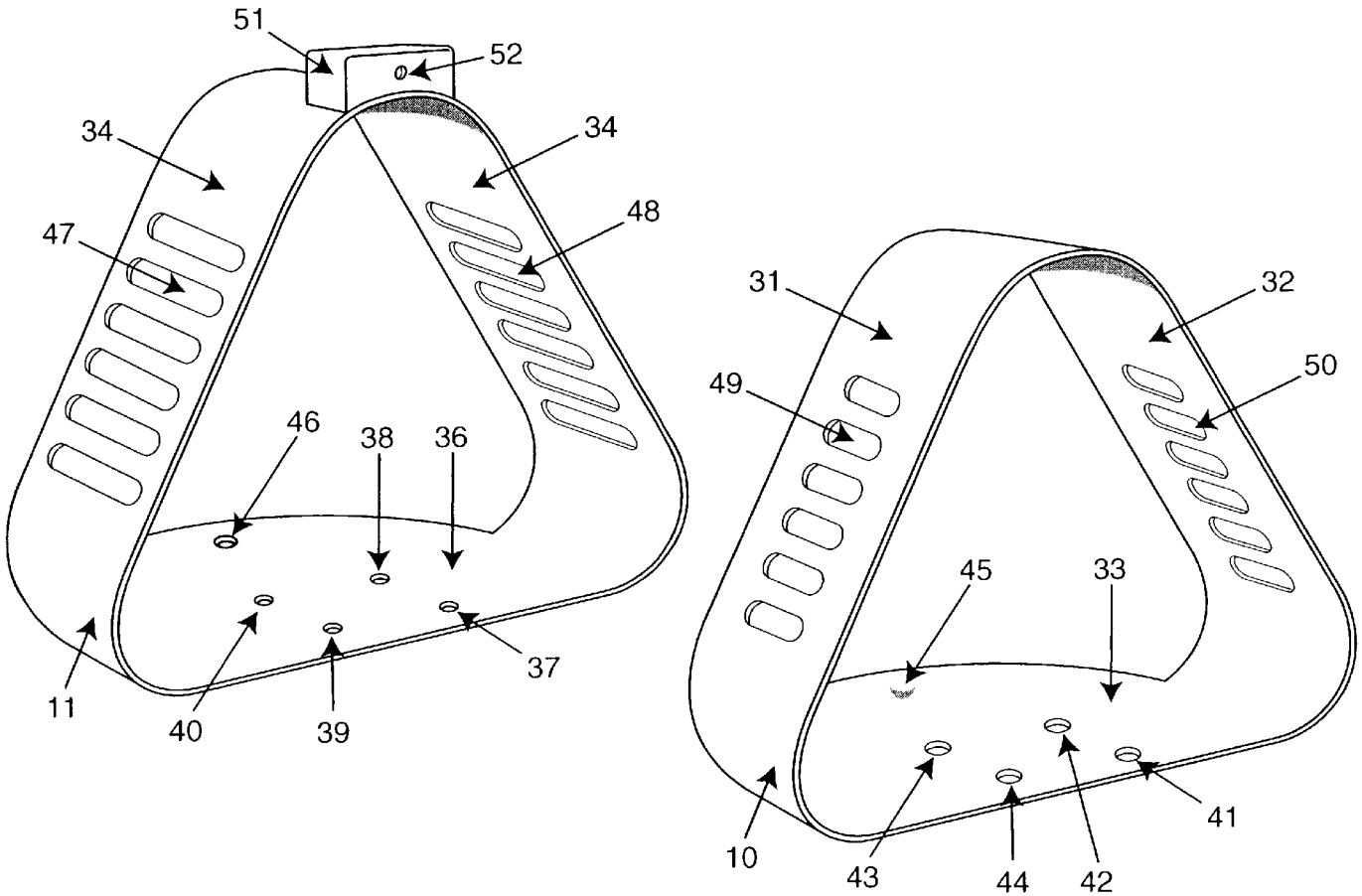
FIG. 12 is a perspective exploded front elevation view of an embodiment of a portable construction of the device of the present invention in which the inner hoop and the outer binder hoop are substantially triangular in shape.
Figure 16:
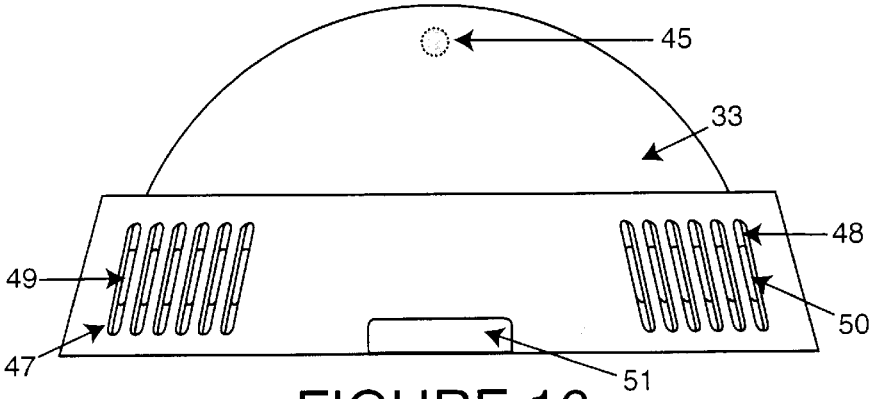
FIG. 16 is a perspective top elevation view of the device shown in FIG. 14.

A portable embodiment of the device of the present invention is shown in FIGS. 12 through 16. In this embodiment, the inner hoop 10 and the outer binder 11 have a substantially similar triangular shape. The front side walls are substantially V-shaped such that the inner hoop 10 has two substantially flat sides 31 and 32 and an extended flat side 33 extending outwards beyond the rear opening therein so that the hoop may rest on a horizontal supporting surface thereby. Similarly, the outer binder 11 has two substantially flat sides 34 and 35 and an extended flat side 36. Mounting openings 37, 38, 39 and 40 are formed in the extended flat side 36 of the outer binder 11 such that, if required, the device may be mounted to a vertical supporting surface. Four similarly positioned associated openings 41, 42, 43, and 44 are formed in the extended flat side 33 of the inner hoop 10. The openings 41, 42, 43 and 44 are relatively larger in size than the openings 37, 38, 39 and 40 respectively and are intended to accommodate the head of the screws or nails used for securing the outer hoop 11 to the vertical supporting surface. A downwardly extending dimple 45 is formed adjacent to the rear edge of the rear opening at the underside of the extended flat side 33 of the inner hoop 10 as best shown in FIGS. 12 and 16. A mating depression 46 is formed adjacent to the rear edge on the upper surface of the outer binder 11 so that the dimple 45 will engage with the depression 46 when the inner hoop 10 and the outer binder 11 are fitted together. This provision is intended to maintain the two parts held together particularly when the device is in storage or during transportation. The dimple and the depression may be formed in either the inner hoop and the outer binder 11 alternatively vice versa to provide the same purpose.

A plurality of transverse elongated openings 47 are formed in the flat side 34, and similarly a plurality of transverse elongated openings 48 are formed in the flat side 35 of the outer binder 11. Also, a plurality of short openings 49 are formed in the flat side 31 and a plurality of similar short openings 50 are formed in the flat side 32 of the inner hoop 10. The short openings 49 will be in registry with the elongated openings 47 and the short openings 50 will be in registry with the elongated openings 48 when the inner hoop 10 and the outer binder 11 are engaged with each other so that they may be separated from engagement by inserting fingers into the elongated openings 47 and 48 and short openings 49 and 50 to slide the inner hoop and the outer binder apart from each other.

The size of the inner hoop 10 is preferably smaller than or equal to the size of a conventional flexible bag so that it is not necessary to over stretch the lip portion of the bag for mounting it onto the inner hoop 10 initially.

The side walls of the inner hoop 10 and outer binder 11 preferably are sloping about 5 to 15 degrees relative to their central axes from the front opening to the rear opening such that the device will lean backwards about 5 to 15 degrees from the vertical axis so as to provide a more stable position when it is resting on a horizontal surface by the extended side.

Figure 13:
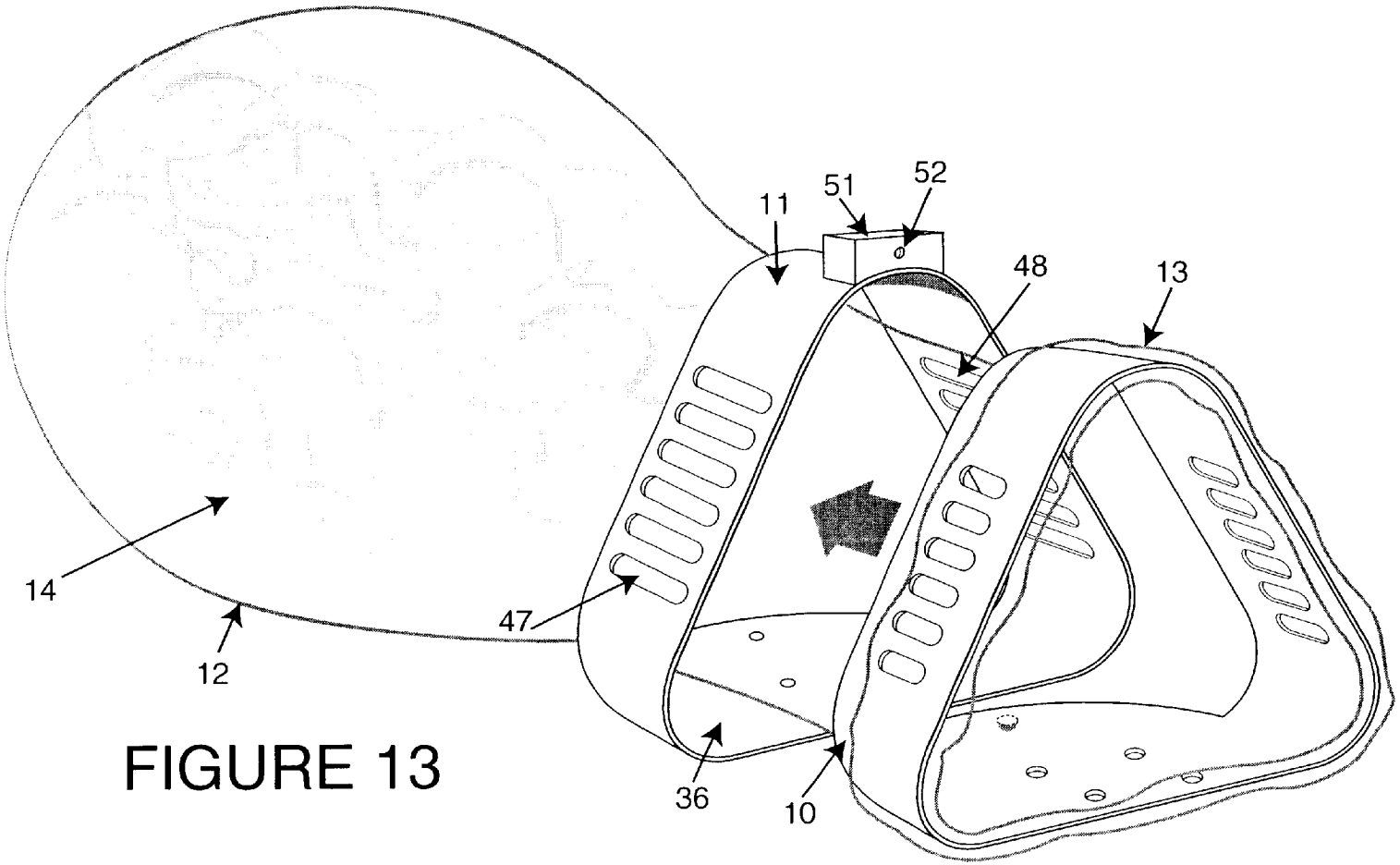
FIG. 13 is a perspective exploded front elevation view of the device in FIG. 12 with a flexible bag mounted thereto.
Figure 14:
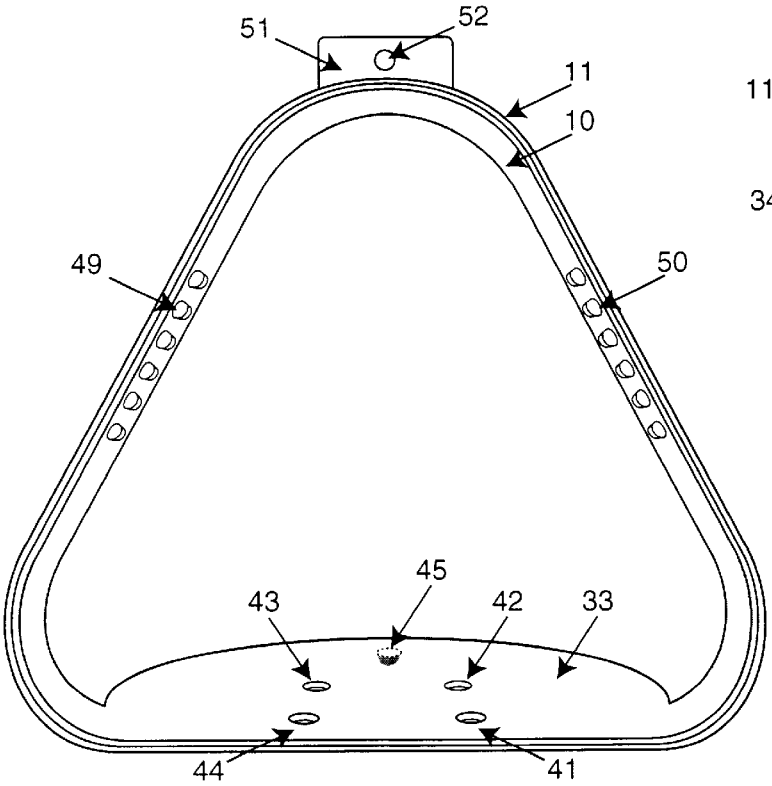
FIG. 14 is a perspective front elevation view of the device in FIG. 12 with the inner hoop and the outer binder hoop fitted together.
Figure 15:
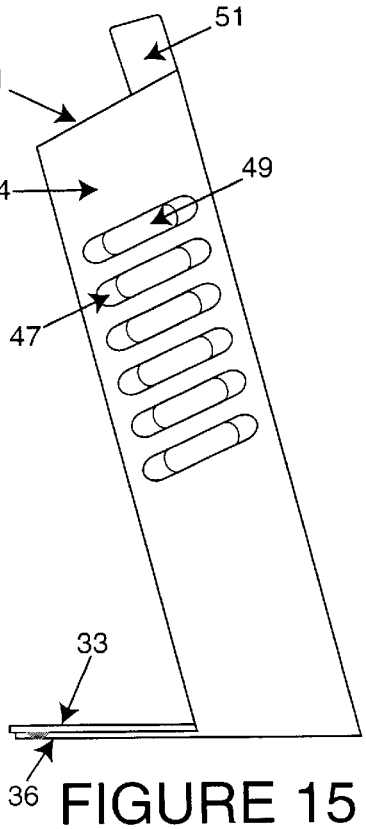
FIG. 15 is a perspective side elevation view of the device shown in FIG. 14.

In operation, as shown in FIG. 13, a flexible bag 12 may be mounted to the device by first inserting it through the inner hoop 10 and wrapping its lip portion 13 over the outer side wall of the inner hoop 10; any excess lip portion of the bag 12 larger than the opening of the inner hoop 10 may be folded sideways to wrap over the hoop. The inner hoop 10 with the lip portion 13 of the bag 12 thus wrapped and folded thereon may then be inserted into the outer binder 11 with the flexible bag 12 now extending through the two engaging parts. The lip portion 13 of the bag 12 is sandwiched between the mating inner hoop 10 and the outer binder 11. Thus, the flexible bag 12 is maintained in the open manner for the filling operation. The device with the flexible bag 12 mounted thereon may be carried with a handle 51 at the top of the outer binder 11, or it may be set on the ground with the extended side 36 of the outer binder 11. In this position, objects on the ground may be simply swept into the bag. A convenience opening 52 is formed in the handle 51, as the handle has a closed front wall, for hanging the device in storage. To remove the bag 12 from the device, the user simply inserts fingers through the elongated openings 47 and 48 of the outer binder and the short openings 49 and 50 to disengage slidably the inner hoop 10 from the outer binder 11.

Figure 17:
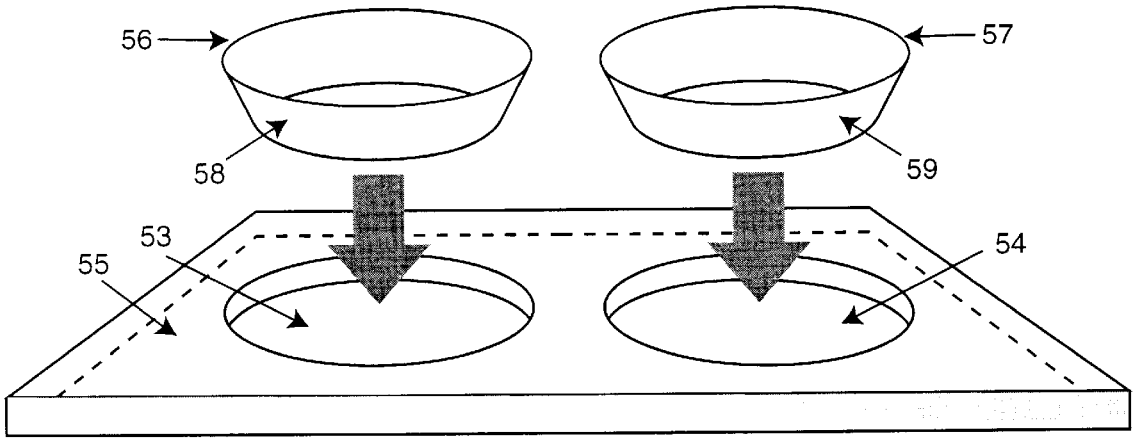
FIG. 17 is a perspective exploded front elevation view of another embodiment of the device of the present invention in which the outer binder is a counter top having mating openings formed therein.
Figure 18:
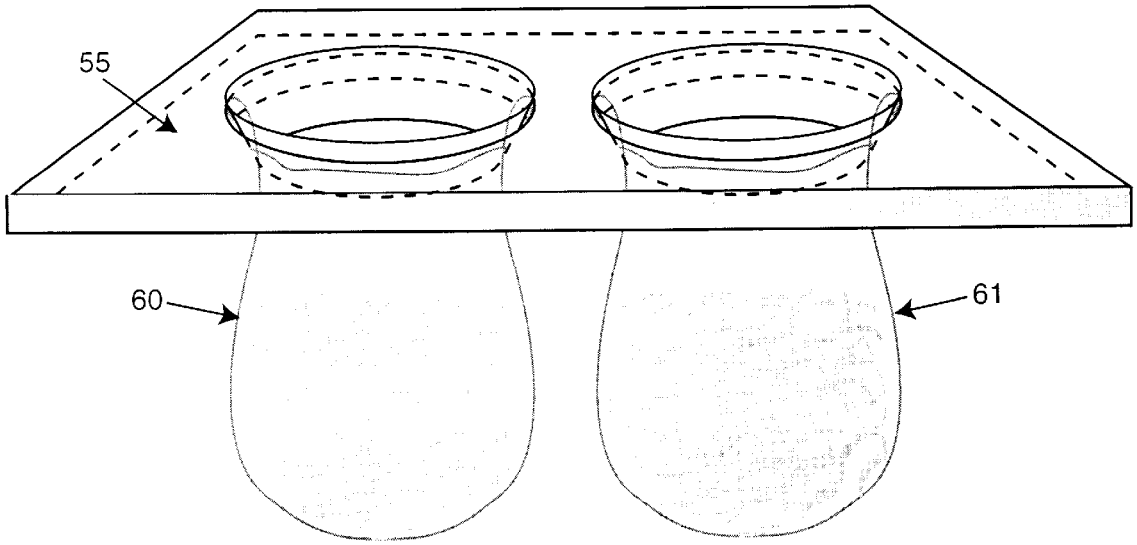
FIG. 18 is a perspective front elevation view of the device of FIG. 17 with flexible bags mounted thereto.

Waste collection bags may be mounted to a counter top with the embodiment as shown in FIGS. 17 and 18. In this embodiment, binding openings 53 and 54 are formed in the counter 55 to serve as outer binders. Two inner hoops 56 and 57 having downwardly and inwardly sloping outer side walls 58 and 59 respectively are provided. Two waste collection bags 60 and 61 may then be mounted to the counter 55 in the similar manner as described above. The two bags construction is shown as an example, a single bag may be mounted in the similar manner by providing only a single binding opening in the counter top.

It can be appreciated by those skilled in the art that the present device is simple to fabricate particularly for the portable embodiment in which the inner hoop and the outer binder are similar in general construction. With the unique construction, a plurality of the device may be conveniently stacked together for transportation or storage.

While the preferred embodiments of the invention have been described above. It will be recognized and understood that various modifications may be made therein and the appended claims are intended to cover all such modifications which may fall within the spirit and scope of the invention.

What I claim is:

1. A method of holding a flexible bag is an open condition, comprising:

inserting said flexible bag into a hoop member having an outer side wall sloping inwardly and downwardly, wrapping a lip portion of said flexible bag over said outer side wall of said hoop member, placing said hoop member with said flexible bag mounted thereon into a binder member, said binder member having an inner wall surface shaped and sized to embrace said outer side wall of said hoop member whereby said lip portion of said flexible bag wrapped over said outer side wall of said hoop member is sandwiched securely between said hoop member and said binder member.

2. A method according to claim 1 wherein said hoop member and said binder member are annular hoops.

3. A method according to claim 1 wherein both of said hoop member and binder member have a top flange formed at a top edge therein and adapted to engage in contact with one another when said hoop member is located within said binder member.

4. A method according to claim 1 wherein said hoop member and said binder member are triangular in shape.

5. A method according to claim 1 wherein said binder member is a counter top having a binding opening formed therein, and said binding opening is shaped and sized to embrace said outer side wall of said hoop member.

6. A device for holding a flexible bag in an open condition, comprising a hoop member having an outer side wall sloping inwardly and downwardly, said hoop member being operative to receive a flexible bag to be inserted therethrough with a lip portion of said bag wrapped over said outer side wall, an outer binder member having inner side wall therein shaped and sized in complementary to said outer side wall of said hoop member, said hoop member and said outer binder member being engageable with one another with said outer side wall of said hoop member juxtaposed to said inner side wall of said binder member.

7. A device according to claim 6 wherein said hoop member and said outer binder member are annular hoops.

8. A device according to claim 7 wherein hoop member has a top edge with a horizontal flange formed therein, and said binder member also has a top edge with a complementary horizontal flange formed therein, said horizontal flange of said hoop member abutting said complementary horizontal flange of said binder member when said hoop member is engaged within said binder member.

9. A device according to claim 8 wherein said binder member includes a support portion adapted for mounting said binder member fixedly to a vertical supporting wall with said binder member extending horizontally in a cantilever manner from said vertical supporting wall.

10. A device according to claim 9 including a reinforcing neck portion provided between said support portion and said binder member, said neck portion adapted to maintain said binder member rigidly in said horizontal position.

11. A device according to claim 10 including a plurality of retainer openings formed in said outer side wall of said hoop member, each one of said retainer openings having a slit opening extending therefrom to a lower edge of said hoop member.

12. A device according to claim 6 wherein said hoop member and said binder member are hoops triangular in shape having two sloping sides and an extended flat side, said extended flat side being operative for supporting said hoop member and said binder member to rest on a ground surface.

13. A device according to claim 12 including a plurality of transverse elongated slot openings formed in each side of said binder member, and a plurality of transverse short slot openings formed in each side of said hoop member, said short slot openings of said hoop member being in registry with said elongated slot openings when said hoop member and said binder member are engaged with each other with said binder member embracing said hoop member.

14. A device according to claim 13 including a dimple formed in an under surface of said extended flat side of said hoop member, and a depression formed in a top surface of said extended flat side of said binder member, said dimple and said depression being operative to engage with one another when said hoop member and said binder member are engaged with one another.

15. A device according to claim 13 including a handle provided at a top corner between said side walls of said binder member.

16. A device according to claim 15 wherein the top of said sides of said hoop member and said outer binder member are slanted backwards at about 5 to 15 degrees to the vertical axis when said device is resting on the ground on said extended flat side.

17. A device according to claim 6 wherein said binder member is a counter top having a binding opening formed therein, said binding opening having an inner side wall shaped and sized complementary to said outer surface of said hoop member and being operative to receive said hoop member to engage therein with said outer surface of said hoop member abutting with said inner side wall of said binding opening.

* * * * *